United States Patent [19]

Watts

[11] 3,952,858

[45] Apr. 27, 1976

[54] COLLECTOR AND LOADING APPARATUS FOR AUGER SPOIL

[76] Inventor: James P. Watts, 6930 E. Pinchot Ave., Scottsdale, Ariz. 85251

[22] Filed: Mar. 25, 1975

[21] Appl. No.: 561,850

[52] U.S. Cl. ..... 198/103; 175/88; 175/209; 198/104; 198/128; 198/209

[51] Int. Cl.[2] ..... B65G 29/00; B65G 31/00; B65G 37/00

[58] Field of Search ..... 198/103, 104, 128, 209; 175/88, 209

[56] References Cited

UNITED STATES PATENTS

| | | | |
|---|---|---|---|
| 3,190,375 | 6/1965 | Pearson | 175/88 |
| 3,894,400 | 7/1975 | Stillwell et al. | 175/88 |

*Primary Examiner*—Evon C. Blunk
*Assistant Examiner*—Jeffrey V. Nase
*Attorney, Agent, or Firm*—John A. Robertson

[57] ABSTRACT

Apparatus for collecting and loading auger spoil comprising a spinning plate having a central opening coaxial with an auger hole, power means for rotating said spinning plate; a fixed circular wall structure spaced from the periphery of the spinning plate, having a lower edge spaced from the upper surface of said spinning plate and formed with a gap; a conveyor belt having one end located at said gap; and a series of rings detachably secured together in stepped relation with the outermost ring connected to the spinning plate at the edge defining the opening therein whereby one or more of said rings may be removed from or added to said series to provide a plate opening of the same diameter as that of a particular auger hole.

9 Claims, 5 Drawing Figures

COLLECTOR AND LOADING APPARATUS FOR AUGER SPOIL

The present invention relates to apparatus for collecting and loading auger spoil and is concerned primarily with apparatus of this character which is susceptible of adjustment to conform to the size of a particular auger hole.

BACKGROUND OF THE INVENTION

The practice of forming vertical holes in earth formations by power driven augers has long been followed. The earth removed from the hole is known in the art as auger spoil. For many years the conventional procedure for disposing of auger spoil has been to merely elevate the auger out of the hole and spin it in the direction opposite to that of its rotation in the digging operation. The spoil is literally spun off of the auger and falls indiscriminately onto the earth surface about the hole.

The above outlined procedure has long been recognized as presenting many undesirable features. Thus the attention of engineers, research workers and inventors has been directed to alleviating this undesirable condition. As a result of these efforts there is now known apparatus for collecting and loading auger spoil which includes a rotating hopper or container which receives spoil spun from an auger elevated thereabove. The container wall is formed with an opening which on each revolution of the container aligns with a gap in a fixed cylindrical wall. One end of a conveyor belt is located at this gap to receive spoil that is discharged from the container by centrifugal force.

This known apparatus has one inherent feature which is highly undesirable. It resides in the fact that it is originally designed to accommodate an auger hole of one size. Whatever the diameter of the auger hole may be it is obvious that the central opening in the bottom of the container cannot be smaller than that of the auger hole because the auger could not then be passed therethrough which is necessary to elevation of the auger. On the other hand if it is of a diameter greater than that of the auger hole spoil will fall down into the space between the auger hole and the edge defining the opening. Such spoil will not be subjected to the centrifugal force generated by spinning the container which discharges the spoil into the conveyor.

Thus, from the viewpoint of maximum efficiency in operation, a spinning annular plate which presents a central opening; the diameter of which may be adjusted to conform to that of a particular auger hole, is indicated as being highly desirable.

OBJECTS OF THE INVENTION

With the foregoing conditions in mind the invention has in view the following objectives:

1. To provide apparatus for collecting and loading auger spoil which includes, as a characteristic and essential element, a spinning annular plate which defines a central opening, with means for adjusting the effective diameter of this opening to bring it into accurate conformity with the diameter of a particular auger hole.

2. To provide, in apparatus of the type noted, bearing races which support the spinning plate for rotation with the lower race being fixedly supported on the ground surface and the upper race depending from the spinning plate.

3. To provide, in apparatus of the character aforesaid, wall structure which upstands from the lower bearing race in spaced relation to the periphery of the spinning plate and which presents lower edges spaced from the upper surface of the spinning plate just sufficiently to provide mechanical clearance thereabove. This wall structure is provided with a gap.

4. To provide, in apparatus of the kind described, a hydraulic motor that is driveably connected to the spinning plate.

5. To provide, in apparatus of the type noted, a conveyor belt having one end at the gap in the wall structure whereby it receives spoil that is discharged from the spinning plate by centrifugal force.

6. To provide, in apparatus of the character aforesaid, a plate and ring assembly comprising the spinning plate and a series of flanged rings which are detachably connected in series to one another with the outer ring similarily connected to the spinning plate. The flange on each ring depends from the central opening defined by that ring.

Various other more detailed objects and advantages of the invention, such as arise in conjunction with carrying out the above ideas in a practical embodiment will in part become apparent, and in part be hereinafter stated, as the description of the invention proceeds.

SUMMARY OF THE INVENTION

The foregoing objects are achieved by providing apparatus including a lower annular bearing member having an upper surface formed with an annular recess constituting a horizontal bearing race. This bearing member is supported above the ground surface about an auger hole by a plurality of hydraulic jacks. An annular plate, hereinafter identified as a spinning plate has an upper bearing member depending from the lower surface thereof with its lower surface formed with an annular recess constituting an upper bearing race. With the lower and upper bearing races assembled bearings are positioned in the races.

The periphery of the spinning plate is formed with gear teeth and meshing therewith is a pinion mounted on the drive shaft of a hydraulic motor which is carried by one of the hydraulic jacks.

Extending radially inwardly from the upper end of each hydraulic jack is a bracket. Secured to these brackets is wall structure comprising an outer metallic wall that is slightly conical, that is it is flared towards its upper end. An inner wall of a flexible material such as heavy belting is flared at a greater angle than the outer wall and is mounted within and to the latter. The inner and outer walls are formed with aligned gaps through which spoil passes as it is discharged from the spinning plate.

To accurately position the lower bearing member and spinning plate relative to an auger hole a plurality of horizontal jacks are equiangularly spaced about the periphery of the lower bearing member which they engage.

A coventional conveyor belt is supported from the ground surface by telescoping supporting members independent of the hydraulic jacks and has one end located at the gap in the wall structure to receive spoil therefrom. This belt is driven by a hydraulic motor mounted on one of the hydraulic jacks.

The spinning plate is a part of a plate and ring assembly which determines the size of the opening through which an auger passes. Each ring defines an opening from the edge of which a flange depends. The rings progressively decrease in diameter from the outermost inwardly. The outer ring is detachably connected to the spinning plate. The remaining rings are detachably connected in series. Thus the innermost ring of any assembly determines the size of the opening therein. As one or more rings is removed the size of the assembly opening is increased. One or more rings may be added to decrease the size of the opening.

For a full and more complete understanding of the invention reference may be had to the following description and accompanying drawings wherein.

DESCRIPTION OF A PREFERRED EMBODIMENT

Figure 1:
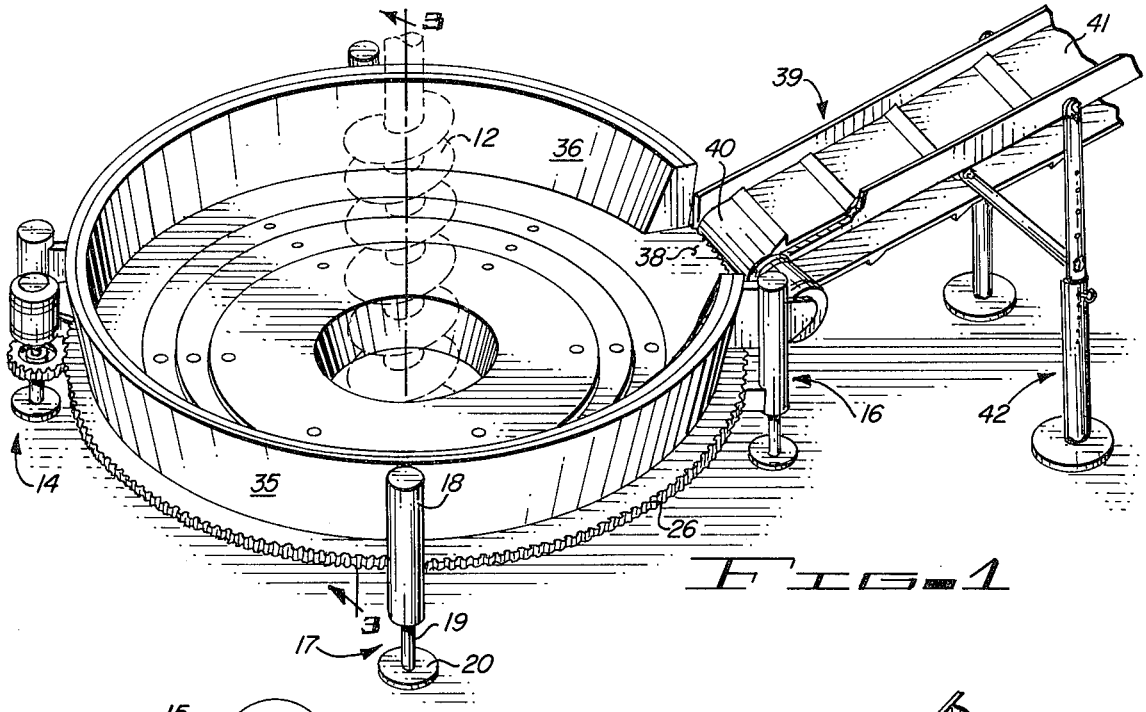
FIG. 1 is a perspective of the auger spoil collecting and loading apparatus of this invention, with the mechanism for horizontal adjustment ommitted.
Figure 2:
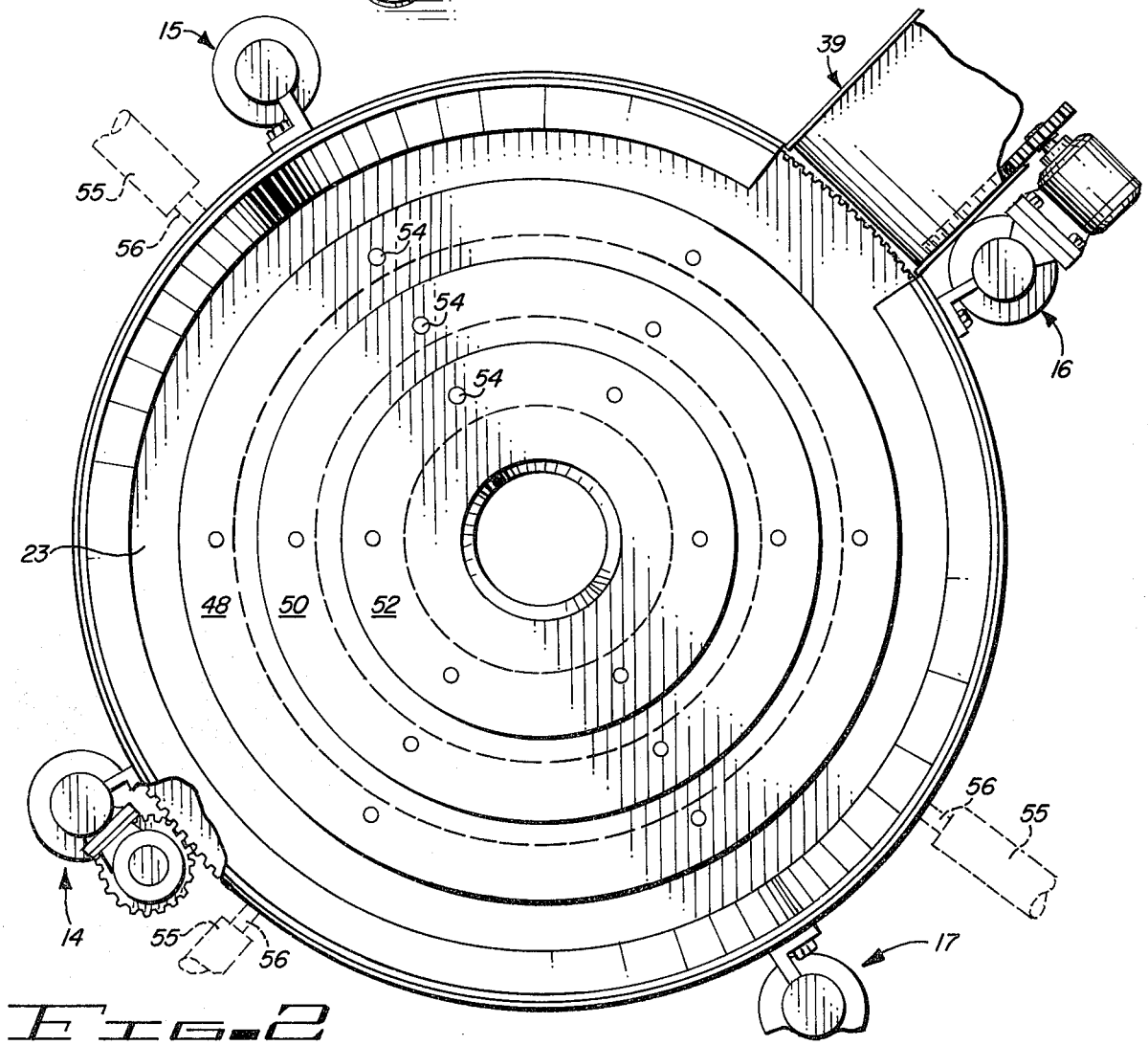
FIG. 2 is a top plan view with the conveyor belt broken away.
Figures 3, 4, 5:
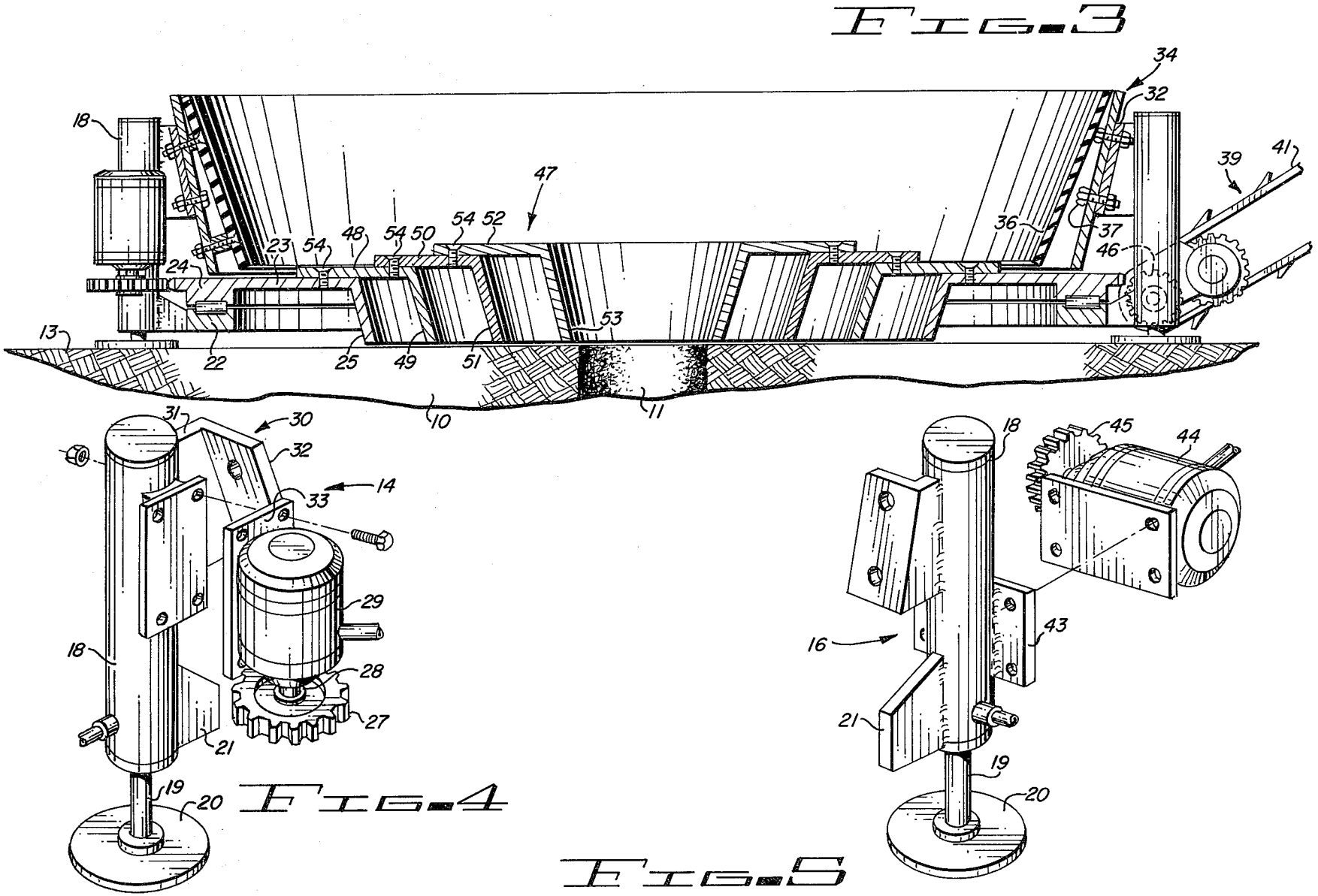
FIG. 3 is a vertical section taken on the plane of the line 3—3 of FIG. 1.
FIG. 4 is a detailed perspective, taken on an enlarged scale, of the hydraulic jack carrying the hydraulic motor for rotating the spinning plate.
FIG. 5 is another perspective on an enlarged scale illustrating the hydraulic jack carrying the hydraulic motor for the conveyor belt and the jack in exploded relation.

Referring now to the drawings wherein like reference characters denote corresponding elements throughout the several views and first more particularly to FIG. 3 an earth formation is shown at 10 as having a hole 11 formed therein by the auger 12 illustrated in broken lines in FIG. 1. In accordance with conventional if not universal practice auger 12 is driven in a clockwise direction to form hole 11 and after being elevated into the position of FIG. 1 is rotated in a counterclockwise direction to literally spin the spoil off the auger. This spoil then falls onto and is handled by the apparatus now to be described.

As shown in FIG. 3 ground 10 presents an exposed surface 13. Supported from surface 13 are a plurality (in the illustrated embodiment four) hydraulic jacks which are identified in their entireties as 14, 15, 16 and 17. All of these jacks have many features in common but there is some differences between jacks 14 and 16 and the remainder. Each jack includes a cylinder 18 which houses a piston (not illustrated) from which extends a piston rod 19 having a ground engaging disc 20 at its lower end.

Extending inwardly from the lower end of each cylinder 18 is a bracket 21 the inner end of which is connected in any preferred manner, such as by welding, to a lower bearing member 22. The latter is formed with an annular recess on its upper face whereby member 22 is constituted a bearing race and will hereinafter be so identified.

An annular spinning plate 23 has an upper bearing race 24 depending from its lower face and aligning with lower race 22. Roller bearings (not designated) are interposed between races 22 and 24 in a conventional manner. Spinning plate 23 defines a central opening from the edge of which depends a flange 25 that is slightly conical. The peripheral edge of plate 23 is formed with fear teeth 26 (FIG. 1). Meshing with gear 26 is a pinion 27 mounted on the drive shaft 28 of a hydraulic motor 29 that is mounted on a bracket which is referred to generally at 30 in FIG. 4 and is carried by jack 14. The latter includes a rib 31 secured to cylinder 18, a wall mounting plate 32 and a motor mounting plate 33.

Fixed wall structure is identified in its entirety at 34. It comprises an outer metallic conical wall 35 and an inner wall 36 which has the property of flexibility to a required degree. It is preferably of a heavy belting such as rubber. Each of jacks 14, 15, 16, and 17 includes a bracket 30 but only the bracket 30 of jack 14 has the motor mounting plate 33. Outer wall 35 is attached to the wall mounting plates 32 of each the bracket 30 of each of the four jacks in any preferred manner as by bolt and nuts 37. Walls 35 and 36 are joined at their upper edges and are conical but at different degrees. Hence they are spaced apart just above spinning plate 23. The spacing of the lower edges of walls 35 and 36 from plate 23 is just sufficient to provide mechanical clearance for rotation of plate 23 relative to wall structure 34.

As depicted in FIG. 1 walls 35 and 36 are formed with aligned gaps 38. A conventional conveyor belt indentified generally at 39 has one end 40 which is located at gap 38 so that the upper ply of 41 of belt receives spoil which is discharged through gap 38 from spinning plate 23. While the angle of inclination of belt 39 is subject to variation by adjustment of the supporting structure shown at 42 it is depicted in the position of FIG. 1 which is desirable for loading the spoil onto a truck or other vehicle.

Referring now to FIG. 5 cylinder 18 of jack 16 is shown as having a motor mounting plate 43. Another hydraulic motor 44 is mounted on a base that is attached to plate 43 as by bolts and nuts. Pinion 45 on the drive shaft of motor 44 engages a gear 46 which is the driving element of conveyor belt 39.

A ring assembly is designated generally 47 (FIG. 3). It comprises a plurality of rings with three being taken as an examplary number as depicted. The assembly 47 comprises an outer ring 48 defining an opening from which depends a conical flange 49; an inermediate ring 50 presenting an opening from the edge of which depends a flange 51 and an inner ring 52 having a depending flange 53.

Outer ring 48 is detachably secured to spinning plate 23 by screws 54, intermediate ring 50 to ring 48 by additional screws 54 and inner ring 52 to ring 50 by similar screws. Thus rings 48, 50, and 52 are assembled in series or stepped relation on plate 23. It is evident that inner ring 52 may be removed from the assembly to provide a central opening of increased diameter, with the same holding true for removal of either or both of rings 50 and 48. Thus the effective diameter of the plate and ring assembly may be adjusted to conform to the diameter of a particular auger hole 11.

To further insure of such accurate conformity and the proper position of the apparatus relative to the auger hole, at last three horizontal jacks 55 are mounted in fixed position on ground surface 13 and spaced equiangularly apart. The jacks 55 may be either of the mechanical type (screw) or hydraulic but in either case each jack 55 includes a member 56 which engages lower bearing race 22. It is evident that with the proper number of rings included in ring assembly 47 jacks 55 may be selectively operated to bring the flange on the innermost ring into accurate alignment with auger hole 11.

OPERATION

While the mode of operation of the instant apparatus is believed to be obvious from the illustrations of the drawings and description of the parts it is briefly outlined as follows:

One or more of the rings of assembly 47 is either removed or added to provide the proper size of the central opening in the plate and ring assembly. With horizontal jacks 55 in fixed position they are selectively operated to bring one of the flanges 25, 49, 51 or 53, that is the flange on the innermost ring into accurate alignment with auger hole 11.

After hole 11 is dug auger 12 is elevated into the broken line position of FIG. 1 and its direction of rotation is reversed. At the same time motors 29 and 44 are started in operation. As auger 12 is rotated spoil therefrom is spun off and falls onto the plate and ring assembly. As the latter rotates the spoil is discharged therefrom through gap 38 and on to the lower end 40 of conveyor belt 39. The spoil is then delivered to a truck or other desired destination.

While a preferred specific embodiment of the invention has hereinbefore been illustrated and described it is to be clearly understood that the invention is not to be limited to the exact construction, mechanisms and devices disclosed because various modifications of these details may be provided in putting the invention into practice.

What is claimed is:

1. In apparatus for collecting and loading auger spoil, said apparatus including:

a. a spinning annular plate supported above the ground surface about an auger hole and presenting a central opening in alignment with said hole, b. power means for rotating said spinning plate, c. fixed circular wall structure spaced from the periphery of said spinning plate and having a lower edge spaced from the upper surface of said spinning plate, d. a gap in said wall structure, and e. a conveyor belt having one end located at said gap; the improvement consisting of:

f. means for adjusting the diameter of said opening in said spinning plate comprising an assembly of rings arranged in series and means for detachably securing adjacent rings of said assembly together in stepped relation and the outermost ring of said assembly to said spinning plate at the edge defining the central opening whereby the diameter of said opening in the spinning plate may be adjusted to substantially the diameter of a particular auger hold.

2. The apparatus of claim 1 in which the fixed wall structure comprises an outer rigid wall and an inner flexible wall, said walls being connected at their upper ends and of conical shape with the inner wall being conical to a greater degree than said outer wall whereby their lower edges are spaced apart above said spinning plate.

3. The apparatus of claim 2 in which the outer wall is metallic and the inner flexible wall is of a heavy belting.

4. The apparatus of claim 1 together with means for horizontally adjusting the spinning plate and wall structure relative to the auger hole to accurately bring the central opening into alignment with the auger hole.

5. The apparatus of claim 4 in which the horizontal adjusting means consists of a plurality of horizontal jacks equiangularly spaced about the periphery of said spinning plate.

6. The apparatus of claim 1 in which the spinning plate has a flange depending from the edge of said central opening and each of said rings has a flange depending from the opening therein.

7. The apparatus of claim 1 together with means for adjusting the height of the spinning plate and wall structure from the ground surface.

8. The apparatus of claim 7 in which the height adjusting means comprising a plurality of jacks equiangularly spaced about said spinning plate together with a lower bearing member connected to said jacks and means for supporting the wall structure from upper ends of said jacks.

9. The apparatus of claim 8 in which the power means for rotating the spinning plate comprises gear teeth on the periphery of said spinning plate, a hydraulic motor mounted on one of said jacks and having a drive shaft, and a pinion on said drive shaft meshing with said gear teeth.

* * * * *

UNITED STATES PATENT OFFICE

CERTIFICATE OF CORRECTION

PATENT NO. : 3,952,858

DATED : April 27, 1976

INVENTOR(S) : James P. Watts

It is certified that error appears in the above-identified patent and that said Letters Patent are hereby corrected as shown below:

Column 6, line 7, delete "hold" and insert -- hole --.

Signed and Sealed this

Third Day of August 1976

[SEAL]

*Attest:*

RUTH C. MASON
*Attesting Officer*

C. MARSHALL DANN
*Commissioner of Patents and Trademarks*